United States Patent [19]

Pliefke

[11] Patent Number: 4,661,219

[45] Date of Patent: Apr. 28, 1987

[54] PROCESS FOR THE ELECTROCHEMICAL ROUGHENING OF ALUMINUM FOR USE IN PRINTING PLATE SUPPORTS

[75] Inventor: Engelbert Pliefke, Wiesbaden, Fed. Rep. of Germany

[73] Assignee: Hoechst Aktiengesellschaft, Frankfurt am Main, Fed. Rep. of Germany

[21] Appl. No.: 825,930

[22] Filed: Feb. 4, 1986

[30] Foreign Application Priority Data

Feb. 6, 1985 [DE] Fed. Rep. of Germany ..... 3503926

[51] Int. Cl.[4] ..... C25F 3/04

[52] U.S. Cl. ..... 204/129.75

[58] Field of Search ..... 204/129.75

[56] References Cited

U.S. PATENT DOCUMENTS

| | | | |
|---|---|---|---|
| 3,193,485 | 7/1965 | Vincent | 204/141 |
| 3,632,486 | 1/1972 | Herrmann et al. | 204/33 |
| 3,766,043 | 10/1973 | Herrmann et al. | 204/207 |
| 3,887,447 | 6/1975 | Sheasby et al. | 204/129.4 |
| 3,963,594 | 6/1978 | Brasko | 204/129.95 |
| 3,980,539 | 9/1976 | Lloyd et al. | 204/129.75 |
| 4,052,275 | 10/1977 | Gumbiner et al. | 204/129.95 |
| 4,072,589 | 2/1978 | Golda et al. | 204/129.4 |
| 4,087,341 | 5/1978 | Takahashi et al. | 204/129.43 |
| 4,166,015 | 8/1979 | Raether | 204/129.75 |
| 4,172,772 | 10/1979 | Ould et al. | 204/129.85 |
| 4,272,342 | 6/1981 | Oda et al. | 204/129.4 |
| 4,294,672 | 10/1981 | Ohba et al. | 204/129.4 |
| 4,301,229 | 11/1981 | Sakaki et al. | 430/158 |
| 4,336,113 | 6/1982 | Walls | 204/17 |

FOREIGN PATENT DOCUMENTS

| | | | |
|---|---|---|---|
| 0036672 | 11/1983 | European Pat. Off. | 204/129.75 |
| 0149833 | 7/1985 | European Pat. Off. | 204/129.75 |
| 120061 | 2/1900 | Fed. Rep. of Germany | 204/129.75 |
| 3030815 | 3/1981 | Fed. Rep. of Germany | 204/129.4 |
| 55-17580 | 2/1980 | Japan | 204/129.75 |
| 879768 | 11/1961 | United Kingdom | 204/129.75 |
| 1400918 | 7/1975 | United Kingdom | 204/129.75 |
| 2047274 | 11/1980 | United Kingdom | 204/129.75 |
| 418300 | 3/1974 | U.S.S.R. | 204/129.75 |
| 448111 | 10/1974 | U.S.S.R. | 204/129.75 |

OTHER PUBLICATIONS

"The Alternating Current Etching of Aluminum Lithographic Sheet" by A. J. Dowell in Transactions of the Institute of Metal Finishing, 1979, vol. 57, pp. 138–144.

*Primary Examiner*—T. M. Tufariello

*Attorney, Agent, or Firm*—Schwartz, Jeffery, Schwaab, Mack, Blumenthal & Evans

[57] ABSTRACT

Disclosed is a process for the electrochemical roughening of aluminum or aluminum alloys useful for printing plate supports, in which a nitric acid electrolyte is employed. The nitric acid electrolyte includes at least one compound containing ammonium ions. Also disclosed is a printing plate support, roughened by the above process which possesses a particularly uniform graining structure.

14 Claims, No Drawings

PROCESS FOR THE ELECTROCHEMICAL ROUGHENING OF ALUMINUM FOR USE IN PRINTING PLATE SUPPORTS

BACKGROUND OF THE INVENTION

The present invention relates to a process for the electrochemical roughening of aluminum for use in printing plate supports. The process is performed by means of an alternating current in an electrolyte comprising nitrate ions and ammonium ions. The present invention also relates to a printing plate support produced by this process.

Printing plates, which is used here to refer to offset-printing plates within the scope of the present invention, usually comprise a support and at least one radiation-sensitive (photosensitive) reproduction layer arranged thereon. The reproduction layer is applied to the support either by the user (in the case of plates which are not pre-coated) or by the industrial manufacturer (in the case of pre-coated plates).

As a layer support material, aluminum or alloys thereof have gained general acceptance in the field of printing plates. In principle, it is possible to use these supports without modifying pretreatment; however, the supports are generally modified in or on their surfaces, for example, by a mechanical, chemical and/or electrochemical roughening process (sometimes also referred to in the literature as graining or etching), a chemical or electrochemical oxidation process and/or a treatment with hydrophilizing agents. In modern continuously working high-speed equipment employed by the manufacturers of printing plate supports and/or pre-coated printing plates, a combination of the aforementioned modifying methods is frequently used, particularly a combination of electrochemical roughening and anodic oxidation, optionally followed by a hydrophilizing step.

Roughening is, for example, carried out in aqueous acids, such as aqueous solutions of HCl or $HNO_3$, or in aqueous salt solutions, such as aqueous solutions of NaCl or $Al(NO_3)_3$, using an alternating current. The peak-to-valley heights (specified, for example, as mean peak-to-valley heights $R_z$) of the roughened surface, which can thus be obtained, are in the range from about 1 to 15 μm, particularly in the range from 2 to 8 μm. The peak-to-valley height is determined according to DIN 4768 (in the October 1970 version). The peak-to-valley height $R_z$ is then the arithmetic mean calculated from the individual peak-to-valley height values of five mutually adjacent individual measurement lengths.

Roughening is, inter alia, carried out in order to improve the adhesion of the reproduction layer to the support and to improve the water/ink balance of the printing form which results from the printing plate upon irradiation (exposure) and developing. By irradiating and developing (or decoating, in the case of electrophotographically-working reproduction layers), the ink-receptive image areas and the water-retaining non-image areas (generally the bared support surface) in the subsequent printing operation are produced on the printing plate, and thus the actual printing form is obtained. The final topography of the aluminum surface to be roughened is influenced by various parameters. By way of example, the following passages from the literature supply information about these parameters:

The paper "The Alternating Current Etching of Aluminum Lithographic Sheet", by A. J. Dowell, published in Transactions of the Institute of Metal Finishing, 1979, Vol. 57, pages 138 to 144, presents basic comments on the roughening of aluminum in aqueous solutions of hydrochloric acid, based on variations of the following process parameters and an investigation of the corresponding effects. The electrolyte composition is changed during repeated use of the electrolyte, for example, in view of the $H^+(H_3O^+)$ ion concentration (measurable by means of the pH) and in view of the $Al^{3+}$ ion concentration, with influences on the surface topography being observed. Temperature variations between 16° C. and 90° C. do not influence changes until temperatures are about 50° C. or higher, the influence becoming apparent, for example, as a significant decrease in layer formation on the surface. Variations in roughening time between 2 and 25 minutes lead to an increasing metal dissolution with increasing duration of action. Variations in current density between 2 and 8 $A/dm^2$ result in higher roughness values with rising current density. If the acid concentration is in a range from 0.17 to 3.3% of HCl, only negligible changes in pit structure occur between 0.5 and 2% of HCl, whereas below 0.5% of HCl, the surface is only locally attacked, and at the high values, an irregular dissolution of aluminum takes place. An addition of $SO_4^{2-}$ ions or $Cl^-$ ions in the form of salts (e.g., by adding $Al_2(SO_4)_3$ or NaCl) can also influence the topography of the roughened aluminum. Rectification of the alternating current shows that, obviously, both half-wave types are necessary to obtain a uniform roughening.

The use of hydrochloric acid or nitric acid as an electrolyte in the roughening of aluminum substrates is thus to be considered as being basically known in the art. Graining can be obtained, which is appropriate for lithographic plates and is within a useful roughness range. In pure nitric acid electrolytes adjustment of an even and uniform surface topography is difficult and it is necessary to keep the operating conditions within very close limits.

The influence of the electrolyte composition on the quality of roughening is, for example, also described in the following publications:

- German Offenlegungsschrift No. 22 50 275 (=British Patent Specification No. 1,400,918) specifies aqueous solutions containing from 1.0 to 1.5% by weight of $HNO_3$ or from 0.4 to 0.6% by weight of HCl and optionally from 0.4 to 0.6% by weight of $H_3PO_4$, for use as electrolytes in the roughening of aluminum for printing plate supports by means of an alternating current,
- German Offenlegungsschrift No. 28 10 308 (=U.S. Pat. No. 4,072,589) mentions aqueous solutions containing from 0.2 to 1.0% by weight of HCl and from 0.8 to 6.0% by weight of $HNO_3$ as electrolytes in the roughening of aluminum with an alternating current.

Additives used in the HCl electrolyte serve the purpose of preventing an adverse local attack in the form of deep pits. The following additives to hydrochloric acid electrolytes are, for example, described:

- in German Offenlegungsschrift No. 28 16 307 (=U.S. Pat. No. 4,172,772): monocarboxylic acids, such as acetic acid,
- in U.S. Pat. No. 3,963,594: gluconic acid,
- in European Patent Application No. 0 036 672: citric acid and malonic acid and
- in U.S. Pat. No. 4,052,275: tartaric acid.

All these organic electrolyte components have the disadvantage of being electrochemically unstable and decompose in the case of a high current load (voltage).

Inhibiting additives, for example, phosphoric acid and chromic acid as described in U.S. Pat. No. 3,887,447 or boric acid as described in German Offenlegungsschrift No. 25 35 142 (=U.S. Pat. No. 3,980,539) have the disadvantage that there is often a local breakdown of the protective effect and individual, particularly pronounced, pits can form in these places.

Japanese Patent Application No. 55-17580 describes roughening by means of an alternating current in a composition comprising hydrochloric acid and an alkali-metal halide to produce a lithographic support material.

German Offenlegungsschrift No. 16 21 115 (=U.S. Pat. Nos. 3,632,486 and No. 3,766,043) describes roughening by means of a direct current in dilute hydrofluoric acid, whereby the web is switched such that it forms the cathode.

German Pat. No. 120 061 describes a treatment for generating a hydrophilic layer by the application of electric current. The treatment can also be performed in hydrofluoric acid.

USSR Pat. No. 448,111 [Chem. Abstracts, Vol. 82 (1975), 147.114 S] and USSR Pat. No. 418,300 [Chem. Abstracts, Vol. 81 (1984), 98.651 e] describe ammonium nitrate solutions or $NH_4NO_3$ additions to nitric acid electrolytes for the electrochemical machining of metals. In the electrochemical machining of metals, fashioning or changing of the form of workpieces is intended to be achieved. For example, it is desirous to produce bores which are free from tensions. Therefore, methods are employed which are basically different from those used in the production of a lithographic support material, where only a slight removal of material takes place and the object is a homogeneously (evenly) roughened surface.

Roughening of printing plate supports serves to produce layer anchoring and water/ink balance and must, therefore, be very homogeneous and free from pits.

Another known possibility for improving the uniformity of electrochemical roughening comprises a modification of the type of electric current employed, including, for example, using an alternating current, in which the anodic voltage and the anodic coulombic input are higher than the cathodic voltage and the cathodic coulombic input, according to German Offenlegungsschrift No. 26 50 762 (=U.S. Pat. No. 4,087,341), the anodic half-cycle period of the alternating current being generally adjusted to be less than the cathodic half-cycle period; this method is, for example, also referred to in German Offenlegungsschrift No. 29 12 060 (=U.S. Pat. No. 4,301,229), German Offenlegungsschrift No. 30 12 135 (=published UK Patent Application No. 2,047,274) or German Offenlegungsschrift No. 30 30 815 (=U.S. Pat. No. 4,272,342), using an alternating current, in which the anodic voltage is markedly increased compared with the cathodic voltage, according to German Offenlegungsschrift No. 14 46 026 (=U.S. Pat. No. 3,193,485), interrupting the current flow for 10 to 120 seconds and reapplying current for 30 to 300 seconds, using an alternating current and, as the electrolyte, an aqueous solution of 0.75 to 2.0N HCl, with the addition of NaCl or $MgCl_2$, according to British Patent No. 879,768. A similar process comprising an interruption of current flow in the anodic or cathodic phase is also disclosed in German Offenlegungsschrift No. 30 20 420 (=U.S. Pat. No. 4,294,672).

The aforementioned methods may lead to relatively uniformly roughened aluminum surfaces, but they sometimes require a comparatively great equipment expenditure and, in addition, are applicable only within closely limited parameters.

SUMMARY OF THE INVENTION

It is, therefore, an object of the present invention to provide an improved process for the electrochemical roughening of aluminum for use in printing plate supports.

Another object of the present invention is to provide a process of the above type which produces a uniform graining structure.

A further object of the present invention is to provide a process of the above type which can be performed without great equipment expenditure and which does not have to be performed within closely limited parameters.

Still another object of the present invention is to provide a printing plate support having a uniform graining structure which is produced by the above process.

Therefore, in accordance with one aspect of the present invention, there is provided a process for the electrochemical roughening of aluminum for use in printing plate supports, comprising the step of electrochemically roughening an aluminum support by application of an alternating current in an electrolyte comprising nitric acid and at least one compound comprising ammonium ions. Preferably, the nitric acid is present in the electrolyte in the range from about 1 to 80 g/l, and more preferably between about 5 and 50 g/l. The ammonium ion-containing compound preferably comprises at least one ammonium salt of an inorganic acid, more specifically ammonium chloride or ammonium nitrate, and is preferably present in the range from about 3 g/l and the saturation limit, more preferably between about 5 and 300 g/l.

In accordance with another aspect of the present invention, there is provided a printing plate support produced by the above process.

Further objects, features, and advantages of the present invention will become more apparent from the detailed description of preferred embodiments which follows.

DETAILED DESCRIPTION OF PREFERRED EMBODIMENTS

The present invention is based on a process for the electrochemical roughening of aluminum or aluminum alloys useful for printing plate supports, in a $HNO_3$ electrolyte under the action of an alternating current. The process of the invention is characterized in that a $HNO_3$ electrolyte is used, to which a compound containing ammonium ions is added.

In a preferred embodiment, a $HNO_3$ electrolyte is employed, in which the nitric acid concentration ranges between about 1 and 80 g/l, particularly preferably between about 5 and 50 g/l, and the concentration of the ammonium compound ranges between about 3 g/l and the saturation limit, preferably between about 5 g/l and about 300 g/l. As the preferred compound containing ammonium ions, ammonium nitrate or ammonium chloride is used. Within the scope of the present invention, it is also intended to use combinations of compounds containing ammonium ions.

It has proven to be particularly advantageous if the electrolyte is additionally admixed with aluminum salts, preferably in an amount from about 20 to 150 g/l.

A surface produced according to the process of the present invention results in a support surface which is variable within wide ranges of roughness height ($R_z$=about 2 to 7 μm), is highly uniform and has excellent lithographic properties.

The process of the present invention is carried out either discontinuously or preferably continuously, using webs of aluminum or aluminum alloys. In continuous processes, the process parameters during roughening are generally within the following ranges: temperature of the electrolyte between about 20° and 60° C., current density between about 3 and 130 A/dm$^2$, dwell time of a material spot to be roughened in the electrolyte between about 10 and 300 seconds, and rate of flow of the electrolyte on the surface of the material to be roughened between about 5 and 100 cm/second. In discontinuous processes, the required current densities are in the lower region and the dwell times in the upper region of the ranges indicated in each case; a flow of the electrolyte can even be dispensed with in these processes.

In addition to the current types mentioned in the description of the prior art, it is also possible to use superimposed alternating current and low-frequency currents.

The following materials which are in the form of a sheet, a foil or a web may, for example, be used for roughening in the process of the present invention:

"Pure aluminum" (DIN Material No. 3.0255), i.e., comprising more than about 99.5% Al, and the following permissible admixtures (maximum total about 0.5%) of 0.3% Si, 0.4% Fe, 0.03% Ti, 0.02% Cu, 0.07% Zn and 0.03% of other substances, or "Al-alloy 3003" (comparable to DIN Material No. 3.0515), i.e., comprising more than 98.5% Al, 0 to 0.3% Mg and 0.8 to 1.5% Mn, as alloying constituents, and 0.5% Si, 0.5% Fe, 0.2% Ti, 0.2% Zn, 0.1% Cu and 0.15% of other substances, as permissible admixtures.

The process of the present invention can, however, also be used with other aluminum alloys.

The electrochemical roughening process according to the present invention may be followed by an anodic oxidation of the aluminum in a further process step, in order to improve, for example, the abrasive and adhesive properties of the surface of the support material. Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. The following are standard methods for the use of aqueous $H_2SO_4$-containing electrolytes for the anodic oxidation of aluminum (see, in this regard, e.g., M. Schenk, Werkstoff Aluminium und seine anodische Oxydation [The Material Aluminum and its Anodic Oxidation], Francke Verlag, Bern, 1948, page 760; Praktische Galvanotechnik [Practical Electroplating], Eugen G. Leuze Verlag, Saulgau, 1970, pages 395 et seq., and pages 518/519; W. Huebner and C. T. Speiser, Die Praxis der anodischen Oxidation des Aluminiums [Practical Technology of the Anodic Oxidation of Aluminum], Aluminium Verlag, Duesseldorf, 1977, 3rd Edition, pages 137 et seq.):

The direct current sulfuric acid process, in which anodic oxidation is carried out in an aqueous electrolyte which conventionally comprises approximately 230 g of $H_2SO_4$ per 1 liter of solution, for 10 to 60 minutes at 10° C. to 22° C., and at a current density of 0.5 to 2.5 A/dm$^2$. In this process, the sulfuric acid concentration in the aqueous electrolyte solution can also be reduced to 8 to 10% by weight of $H_2SO_4$ (about 100 g of $H_2SO_4$ per liter), or it can also be increased to 30% by weight (365 g $H_2SO_4$ per liter), or more.

The "hard-anodizing process" is carried out using an aqueous electrolyte, comprising $H_2SO_4$ in a concentration of 166 g of $H_2SO_4$ per liter (or about 230 g of $H_2SO_4$ per liter), at an operating temperature of 0° to 5° C., and at a current density of 2 to 3 A/dm$^2$, for 30 to 200 minutes, at a voltage which rises from approximately 25 to 30V at the beginning of the treatment, to approximately 40 to 100V toward the end of the treatment.

In addition to the processes for the anodic oxidation of printing plate support materials which have already been mentioned in the preceding paragraph, the following processes can, for example, also be used: the anodic oxidation of aluminum can e.g., be carried out in an aqueous, $H_2SO_4$-containing electrolyte, in which the content of $Al^{3+}$ ions is adjusted to values exceeding 12 g/l (according to German Offenlegungsschrift No. 28 11 396=U.S. Pat. No. 4,211,619), in an aqueous electrolyte containing $H_2SO_4$ and $H_3PO_4$ (according to German Offenlegungsschrift No. 27 07 810=U.S. Pat. No. 4,049,504), or in an aqueous electrolyte containing $H_2SO_4$, $H_3PO_4$ and $Al^{3+}$ ions (according to German Offenlegungsschrift No. 28 36 803=U.S. Pat. No. 4,229,226).

Direct current is preferably used for the anodic oxidation, but it is also possible to use alternating current or a combination of these types of current (for example, direct current with superimposed alternating current).

The layer weights of aluminum oxide range from about 1 to 10 g/m$^2$, which corresponds to layer thicknesses from about 0.3 to 3 μm. After the electrochemical roughening step and prior to an anodic oxidation step, an etching modification of the roughened surface may additionally be performed, as described, for example, in German Offenlegungsschrift No. 30 09 103. A modifying intermediate treatment of this kind can, inter alia, enable the formation of abrasion-resistant oxide layers and reduce the tendency to scumming in the subsequent printing operation.

The anodic oxidation step of the aluminum support material for printing plates is optionally followed by one or more post-treatment steps. Post-treatment is particularly understood to be a hydrophilizing chemical or electrochemical treatment of the aluminum oxide layer, for example, an immersion treatment of the material in an aqueous solution of polyvinyl phosphonic acid according to German Pat. No. 16 21 478 (=British Pat. No. 1,230,447), an immersion treatment in an aqueous solution of an alkali-metal silicate according to German Auslegeschrift No. 14 71 707 (=U.S. Pat. No. 3,181,461), or an electrochemical treatment (anodization) in an aqueous solution of an alkali-metal silicate according to German Offenlegungsschrift No. 25 32 769 (=U.S. Pat. No. 3,902,976). These post-treatment steps serve, in particular, to even further improve the hydrophilic properties of the aluminum oxide layer, which are already sufficient for many fields of application, while maintaining the other well-known properties of the layer.

Suitable photosensitive reproduction layers basically comprise any layers which, after exposure, optionally followed by development and/or fixing, yield a surface in image configuration, which can be used for printing and/or which represents a relief image of an original. The layers are applied to the support materials, either by the manufacturer of presensitized printing plates or so-called dry resists or directly by the user.

The photosensitive reproduction layers include those which are described, for example, in "Light-Sensitive Systems", by Jaromir Kosar, published by John Wiley & Sons, New York, 1965: layers containing unsaturated compounds, which, upon exposure, are isomerized, rearranged, cyclized, or crosslinked (Kosar, Chapter 4); layers containing compounds, e.g., monomers or prepolymers, which can be photopolymerized, which, on being exposed, undergo polymerization, optionally with the aid of an initiator (Kosar, Chapter 5); and layers containing o-diazoquinones, such as naphthoquinone-diazides, p-diazoquinones, or condensation products of diazonium salts (Kosar, Chapter 7).

Other suitable layers include the electrophotographic layers, i.e., layers which contain an inorganic or organic photoconductor. In addition to the photosensitive substances, these layers can, or course, also contain other constituents, such as for example, resins, dyes, pigments, wetting agents, sensitizers, adhesion promoters, indicators, plasticizers or other conventional auxiliary agents. In particular, the following photosensitive compositions or compounds can be employed in the coating of the support materials.

Positive-working o-quinone diazide compounds, preferably o-naphthoquinone diazide compounds, which are described, for example, in German Pat. Nos. 854 890, No. 865 109, No. 879 203, No. 394 959, No. 938 233, No. 11 09 521, No. 11 44 705, No. 11 18 606, No. 11 20 273 and No. 11 24 817.

Negative-working condensation products from aromatic diazonium salts and compounds with active carbonyl groups, preferably condensation products formed from diphenylamine-diazonium salts and formaldehyde, which are described, for example, in German Pat. Nos. 596 731, No. 11 38 399, No. 11 38 400, No. 11 38 401, No. 11 42 871, and No. 11 54 123, U.S. Pat. Nos. 2,679,498 and No. 3,050,502 and British Pat. No. 712 606.

Negative-working co-condensation products of aromatic diazonium compounds, for example, according to German Offenlegungsschrift No. 20 24 244, which possess, in each case, at least one unit of the general types $A(-D)_n$ and B, connected by a divalent linking member derived from a carbonyl compound which is capable of participating in a condensation reaction. In this context, these symbols are defined as follows: A is the radical of a compound which contains at least two aromatic carbocyclic and/or heterocyclic nuclei, and which is capable, in an acid medium, or participating in a condensation reaction with an active carbonyl compound, at one or more positions; D is a diazonium salt group which is bonded to an aromatic carbon atom of A; n is an integer from 1 to 10; and B is the radical of a compound which contains no diazonium groups and which is capable, in an acid medium, of participating in a condensation reaction with an active carbonyl compound, at one or more positions on the molecule.

Positive-working layers according to German Offenlegungsschrift No. 26 10 842, which contain a compound which, on being irradiated, splits off an acid, a compound which possesses at least one C—O—C group, which can be split off by acid (e.g., an orthocarboxylic acid ester group, or a carboxamide-acetal group), and, if appropriate, a binder.

Negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. Nos. 2,760,863 and No. 3,060,023, and in German Offenlegungsschrift No. 20 64 079 and No. 23 61 041. Suitable photo-initiators are, inter alia, benzoin, benzoin ethers, polynuclear quinones, acridine derivatives, phenazine derivatives, quinoxaline derivatives, quinazoline derivatives, or synergistic mixtures of various ketones. A large number of soluble organic polymers can be employed as binders, for example, polyamides, polyesters, alkyd resins, polyvinyl alcohol, polyvinylpyrrolidone, polyethylene oxide, gelatin or cellulose ethers.

Negative-working layers according to German Offenlegungsschrift No. 30 36 077, which contain, as the photosensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photosemiconducting layers to the support materials, such as described, for example, in German Pat. Nos. 11 17 391, No. 15 22 497, No. 15 72 312, No. 23 22 046 and No. 23 22 047, as a result of which highly photosensitive electrophotographic layers are produced.

The materials for printing plate supports, which have been roughened according to the process of the present invention, exhibit a very uniform topography, which positively influences the stability of print runs and the water/ink balance during printing with printing forms manufactured from these supports. Compared with the use of pure nitric acid electrolytes, "pits" (pronounced depressions, in comparison to the surrounding roughening) occur less frequently and can even be completely suppressed. With the process of the present invention it is, in particular, possible to also produce even, pit-free supports. A direct comparison between Comparative Examples C22, C24, C26 and C28 and Examples 21, 23, 25 and 27 shows the effect of the ammonium ion addition as a means of obtaining surfaces which are more even, and, in addition, uniform. These surface properties can be materialized without particularly great equipment expenditure.

EXAMPLES

An aluminum sheet (DIN Material No. 3.0255) is first cleaned in an aqueous solution containing 20 g/l of NaOH, for 60 seconds, at room temperature. Roughening is carried out in the electrolyte systems specified in each case. The invention is, however, not limited to the illustrative examples.

The classification into quality grades (surface topography with respect to uniformity, absence of pits and overall roughness) is effected by visual estimation under a microscope, quality grade "1" (best grade) being assigned to a surface which is homogeneously roughened and free from pits. Quality grade "10" (worst grade) is assigned to a surface showing great pits of more than 30 μm in size and/or an extremely nonuniformly roughened or almost mill-finished surface.

TABLE I

| Example No. | Concentration $HNO_3$ (g/l) | $Al(NO_3)_3 \times 9H_2O$ (g/l) | $NH_4NO_3$ (g/l) | Current Density ($A/dm^2$) | Time (sec) | Quality Grade 1 = very good 10 = extremely bad |
|---|---|---|---|---|---|---|
| 1 | 15 | 50 | 100 | 60 | 13 | 3 |
| 2 | 15 | 50 | 100 | 60 | 17 | 2-3 |
| 3 | 15 | 50 | 100 | 80 | 10 | 2-3 |
| 4 | 15 | 50 | 100 | 100 | 6 | 3 |
| 5 | 25 | 60 | 150 | 100 | 12 | 2 |
| 6 | 25 | 60 | 150 | 100 | 14 | 2 |
| 7 | 25 | 60 | 150 | 100 | 16 | 1-2 |
| 8 | 25 | 30 | 150 | 100 | 14 | 1-2 |
| 9 | 25 | 30 | 150 | 100 | 10 | 2 |
| 10 | 25 | 30 | 150 | 80 | 15 | 2 |
| 11 | 25 | 60 | 150 | 120 | 14 | 2 |
| 12 | 25 | 10 | 150 | 80 | 14 | 2 |
| 13 | 25 | 10 | 150 | 100 | 12 | 2 |
| 14 | 25 | 10 | 150 | 120 | 10 | 1-2 |
| 15 | 25 | 10 | 150 | 140 | 8 | 2 |
| 16 | 30 | 50 | 150 | 140 | 10 | 1-2 |
| 17 | 30 | 50 | 150 | 140 | 8 | 2 |
| 18 | 25 | — | 150 | 80 | 12 | 2 |
| 19 | 25 | — | 150 | 80 | 15 | 2-3 |
| 20 | 25.5 | — | 200 | 80 | 12 | 2 |

TABLE II

| Example No. | Concentration $HNO_3$ (g/l) | $Al(NO_3)_3 \times 9H_2O$ (g/l) | $NH_4NO_3$ (g/l) | Current Density ($A/dm^2$) | Time (sec) | $R_z$-Value (μm) | Quality Grade 1 = very good 10 = extremely bad |
|---|---|---|---|---|---|---|---|
| 21 | 15 | 50 | 100 | 40 | 30 | 4.0 | 2-3 |
| c22 | 15 | 50 | — | 40 | 30 | 7.7 | 9 |
| 23 | 15 | 50 | 100 | 60 | 20 | 3.5 | 2-3 |
| c24 | 15 | 50 | — | 60 | 20 | 7.5 | 10 |
| 25 | 25 | 50 | 100 | 80 | 10 | 2.7 | 2-3 |
| c26 | 25 | 50 | — | 80 | 10 | 6.7 | 9 |
| 27 | 25 | 50 | 150 | 100 | 8 | 3.3 | 1-2 |
| c28 | 25 | 50 | — | 100 | 8 | 6.9 | 8 |

TABLE III

| Example No. | Concentration $HNO_3$ (g/l) | $Al(NO_3)_3x9H_2O$ (g/l) | $NH_4Cl$ (g/l) | Current Density ($A/dm^2$) | Time (sec) | $R_z$-Value (μm) | Quality Grade 1 = very good 10 = extremely bad |
|---|---|---|---|---|---|---|---|
| 29 | 9 | — | 150 | 60 | 17 | 3.6 | 2 |
| 30 | 9 | — | 150 | 80 | 13 | 3.4 | 2-3 |
| 31 | 9 | — | 150 | 80 | 15 | 3.9 | 2 |
| 32 | 9 | — | 150 | 100 | 8 | 2.8 | 2-3 |
| 33 | 9 | — | 150 | 100 | 12 | 3.2 | 2 |

What is claimed is:

1. A process for the electrochemical roughening of aluminum for use in printing plate supports, comprising the step of electrochemically roughening an aluminum support by application of an alternating current in an electrolyte comprising nitric acid, an aluminum salt which has a concentration within the range from about 20 to 150 g/l, based on said electrolyte, and at least one compound comprising ammonium ions.

2. A process as claimed in claim 1, wherein the nitric acid concentration in said electrolyte is within the range from about 1 to 80 g/l.

3. A process as claimed in claim 2, wherein the nitric acid concentration is within the range from about 5 and 50 g/l.

4. A process as claimed in claim 1, wherein the concentration of said ammonium ion-containing compound in said electrolyte is within the range between about 3 g/l and the saturation limit.

5. A process as claimed in claim 4, wherein the concentration of said ammonium ion-containing compound is within the range from about 5 g/l and 300 g/l.

6. A process as claimed in claim 1, wherein said ammonium ion-containing compound comprises at least one ammonium salt of an inorganic acid.

7. A process as claimed in claim 6, wherein said ammonium ion-containing compound comprises ammonium nitrate.

8. A process as claimed in claim 6, wherein said ammonium ion-containing compound comprises ammonium chloride.

9. A process as claimed in claim 1, wherein said aluminum salt comprises aluminum nitrate.

10. A process as claimed in claim 1, wherein the current density is greater than about 30 $A/dm^2$.

11. A process as claimed in claim 1, wherein said roughening step is performed for a period from about 3 to 30 seconds.

12. A printing plate support produced by the process as claimed in claim 1.

13. A process as claimed in claim 1, wherein said electrolyte is maintained at a temperature within the range from about 20° to 60° C.

14. A process as claimed in claim 1, wherein said electrolyte solution consists essentially of nitric acid, an aluminum salt and at least one compound comprising ammonium ions.

* * * * *